US011932819B2

(12) United States Patent
Scherer et al.

(10) Patent No.: US 11,932,819 B2
(45) Date of Patent: Mar. 19, 2024

(54) LUBRICANT COMPRISING A DIESTER OF ADIPIC ACID WITH A TRIDECANOL

(71) Applicant: BASF SE, Ludwigshafen am Rhein (DE)

(72) Inventors: Markus Scherer, Ludwigshafen am Rhein (DE); Jan Strittmatter, Ludwigshafen am Rhein (DE); Boris Breitscheidel, Ludwigshafen am Rhein (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 17/291,134

(22) PCT Filed: Oct. 28, 2019

(86) PCT No.: PCT/EP2019/079417
§ 371 (c)(1),
(2) Date: May 4, 2021

(87) PCT Pub. No.: WO2020/094445
PCT Pub. Date: May 14, 2020

(65) Prior Publication Data

US 2021/0388281 A1 Dec. 16, 2021

(30) Foreign Application Priority Data

Nov. 5, 2018 (EP) ..... 18204273

(51) Int. Cl.
*C10M 105/36* (2006.01)
*C10M 169/04* (2006.01)
*C10M 177/00* (2006.01)

(52) U.S. Cl.
CPC ..... *C10M 105/36* (2013.01); *C10M 169/04* (2013.01); *C10M 177/00* (2013.01); *C10M 2207/2825* (2013.01)

(58) Field of Classification Search
CPC ..... C10M 105/36; C10M 169/04; C10M 177/00; C10M 2207/2825;
(Continued)

(56) References Cited

U.S. PATENT DOCUMENTS 3,481,873 A 12/1969 Aylesworth
4,076,842 A * 2/1978 Plank ..... B01J 29/70 585/533

(Continued)

FOREIGN PATENT DOCUMENTS

WO 2010/057847 A1 5/2010

OTHER PUBLICATIONS

International Preliminary Report on Patentability received for PCT Patent Application No. PCT/EP2019/079417, dated May 20, 2021, 7 pages.

(Continued)

*Primary Examiner* — Latosha Hines
(74) *Attorney, Agent, or Firm* — Faegre Drinker Biddle & Reath LLP

(57) ABSTRACT

The invention relates to a lubricant comprising a diester of adipic acid with a tridecanol mixture which comprises 20 to 60% of at least triply branched tridecanols, 10 to 50% doubly branched tridecanols, and 5 to 30% singly branched and/or linear tridecanols, and where the percentages are determined by gas chromatography.

17 Claims, 1 Drawing Sheet

(58) Field of Classification Search
CPC ..... C10M 2207/2835; C10N 2020/02; C10N 2020/069; C10N 2020/071; C10N 2030/10
See application file for complete search history.

(56) References Cited

U.S. PATENT DOCUMENTS 5,245,072 A * 9/1993 Giacobbe ..... C11D 1/72 560/204
6,656,888 B1 * 12/2003 Zehler ..... C10M 117/04 508/485
6,664,216 B1 * 12/2003 Lakes ..... C10M 133/16 508/496
2003/0187114 A1 * 10/2003 Breitscheidel ..... C07C 67/08 560/76
2016/0355719 A1 * 12/2016 Fukushima ..... F25B 1/00
2017/0175026 A1 * 6/2017 Sharko ..... C10M 133/04

OTHER PUBLICATIONS

International Search Report and Written Opinion received for PCT Patent Application No. PCT/EP2019/079417, dated Dec. 6, 2019, 8 pages.
E. SZ. Kováts, "Chapter 7: Gas chromatographic characterization of organic substances in the retention index system", Advances in Chromatography, vol. 1, 1965, pp. 229-247.
E. SZ. Kováts, "Zusammenhänge zwischen Struktur und gasehromatographischen Daten organischer Verbindungen", Fresenius' Zeitschrift für analytische Chemie, vol. 181, 1961, pp. 351-364.
European Search Report for EP Patent Application No. 18204273.9, dated Apr. 16, 2019, 3 pages.

* cited by examiner

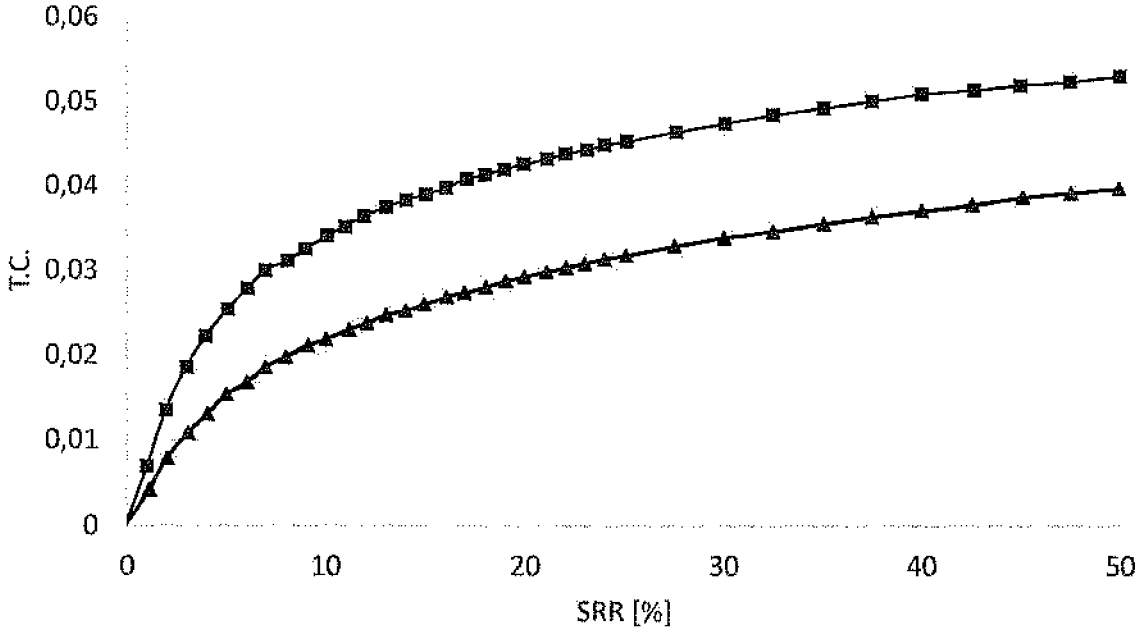
0,06
0,05
0,04
0,03
0,02
0,01
0
T.C.
0
10
20
30
40
50
SRR [%]

LUBRICANT COMPRISING A DIESTER OF ADIPIC ACID WITH A TRIDECANOL

CROSS-REFERENCE TO RELATED APPLICATIONS

This application is a national stage application (under 35 U.S.C. § 371) of PCT/EP2019/079417, filed Oct. 28, 2019, which claims benefit of European Application No. 18204273.9, filed Nov. 5, 2018, both of which are incorporated herein by reference in their entirety.

DESCRIPTION

The invention relates to a lubricant comprising a diester of adipic acid with a tridecanol mixture which comprises 20 to 60% of at least triply branched tridecanols, 10 to 50% doubly branched tridecanols, and 5 to 30% singly branched and/or linear tridecanols, and where the percentages are determined by gas chromatography. Combinations of preferred embodiments with other preferred embodiments are within the scope of the present invention.

U.S. Pat. No. 5,245,072 discloses ditridecyl adipate as lubricant ester based on commercially available tridecanol isomer mixture Exxal® 13 from Mobil Oil, USA.

Object of the present invention was to further improve the performance of lubricants comprising tridecyl adipate diesters, such as the viscosity index, the pour point, the flash point, the wear scar, the friction, or the thermal oxidative stability.

The object was solved by a lubricant comprising a diester of adipic acid with a tridecanol mixture which comprises 20 to 60% of at least triply branched tridecanols, 10 to 50% doubly branched tridecanols, and 5 to 30% singly branched and/or linear tridecanols, and where the percentages are determined by gas chromatography.

The object was also solved by a method for reducing friction between moving surfaces comprising the step of contacting the surfaces with the lubricant; by a use of the diester for reducing the viscosity index of a lubricant; or by a use of the diester for reducing the pour point of a lubricant.

BRIEF DESCRIPTION OF THE DRAWINGS

FIG. 1 is a graph showing the slide-roll ratio vs. traction coefficient for the inventive diester of Example 2 (squares) and for the comparative diester (triangles).

The tridecannol mixture may be obtainable, preferably it is obtained, by hydroformylation and hydrogenation of a mixture of isomeric dodecenes.

The mixture of isomeric dodecenes may be obtainable, preferably it is obtained, by reacting a hydrocarbon mixture comprising butenes on a heterogeneous catalyst.

In a multistage process starting from a hydrocarbon mixture comprising butenes, a first step dimerizes the butenes to give a mixture of isomeric octenes and dodecenes. The main product produced here is the octenes, while the proportion of dodecenes produced is generally from 5 to 20 percent by weight, based on the reactor discharge. The dodecenes are then isolated from the reaction mixture, hydroformylated to give the corresponding C13 aldehydes, and then hydrogenated to give isotridecanols.

It is therefore preferable to obtain the mixture of isomeric dodecenes by bringing a hydrocarbon mixture comprising butenes into contact with a heterogeneous catalyst which comprises nickel oxide. The isobutene content of the hydrocarbon mixture is preferably 5 percent by weight or less, in particular 3 percent by weight or less, particularly preferably 2 percent by weight or below, and most preferably 1.5 percent by weight or less, based in each case on the total butene content. A suitable hydrocarbon stream is what is known as the C4 cut, a mixture composed of butenes and butanes, which is available in large amounts from FCC plants or steam crackers. Particular preference is given to the use of raffinate II as starting material, this being an isobutene-impoverished C4 cut.

One preferred starting material comprises from 50 to 100 percent by weight, preferably from 80 to 95 percent by weight, of butenes, and from 0 to 50 percent by weight, preferably from 5 to 20 percent by weight, of butanes. The following composition of the butene fraction may be given as a general quantitative guideline: 1-butene from 1 to 99 percent by weight cis-2-butene from 1 to 50 percent by weight trans-2-butene from 1 to 99 percent by weight isobutene from 1 to 5 percent by weight.

Catalysts which may be used are catalysts known per se which comprise nickel oxide. Supported nickel oxide catalysts may be used, suitable support materials being silica, alumina, aluminosilicates, aluminosilicates with a phyllosilicate structure, and zeolites. Particularly suitable catalysts are precipitation catalysts obtained by mixing aqueous solutions of nickel salts and silicates, e.g. mixing sodium silicate and nickel nitrate, where appropriate with other constituents, such as aluminum salts, e.g. aluminum nitrate, and calcining.

Particular preference is given to catalysts substantially composed of NiO, $SiO_2$, $TiO_2$ and/or $ZrO_2$, and also, where appropriate, $Al_2O_3$. Most preference is given to a catalyst whose active substantial constituents are from 10 to 70 percent by weight of nickel oxide, from 5 to 30 percent by weight of titanium dioxide and/or zirconium dioxide, and from 0 to 20 percent by weight of aluminum oxide, the remainder, to give 100 percent by weight, being silicon dioxide. A catalyst of this type is obtainable by precipitating the catalyst composition at a pH of from 5 to 9 by adding an aqueous solution comprising nickel nitrate to an alkali metal water glass solution which comprises titanium dioxide and/or zirconium dioxide, filtering, drying and annealing at from 350 to 650 degrees C.

The hydrocarbon mixture comprising butenes is preferably brought into contact with the catalyst at from 30 to 280 degrees C., in particular from 30 to 140 degrees C., and particularly preferably from 40 to 130 degrees C. The pressure here is preferably from 10 to 300 bar, in particular from 15 to 100 bar, and particularly preferably from 20 to 80 bar. This pressure is usefully adjusted so that the olefin-rich hydrocarbon mixture is liquid or in the supercritical state at the temperature selected.

Examples of suitable apparatuses for bringing the hydrocarbon mixture comprising butenes into contact with the heterogeneous catalyst are tube-bundle reactors and shaft furnaces. Shaft furnaces are preferred because the capital expenditure costs are lower. The dimerization may be carried out in a single reactor, where the oligomerization catalyst may have been arranged in one or more fixed beds. Another way is to use a reactor cascade composed of two or more, preferably two, reactors arranged in series, where the butene dimerization in the reaction mixture is driven to only partial conversion on passing through the reactor or reactors preceding the last reactor of the cascade, and the desired final conversion is not achieved until the reaction mixture passes through the last reactor of the cascade. The butene dimerization preferably takes place in an adiabatic reactor or in an adiabatic reactor cascade.

After leaving the reactor or, respectively, the last reactor of a cascade, the dodecenes formed are separated off from the octenes and, where appropriate, from the higher oligomers, and from the unconverted butenes and butanes, in the reactor discharge. The octenes are generally the main product.

In the second step of the process, the dodecenes obtained are converted in a manner known per se into the aldehydes with molecules lengthened by one carbon atom, by hydroformylation using synthesis gas. The hydroformylation takes place in the presence of catalysts dissolved homogeneously in the reaction medium. The catalysts used here are generally compounds or complexes of metals of the transition group VIII, especially compounds or, respectively, complexes of Co, Rh, Ir, Pd, Pt or Ru, these being either unmodified or modified with, for example, amine- or phosphine-containing compounds.

For the purposes of the present invention, the hydroformylation preferably takes place in the presence of a cobalt catalyst, preferably at from 120 to 240 degrees C., in particular from 160 to 200 degrees C., under a synthesis-gas pressure of from 150 to 400 bar, in particular from 250 to 350 bar. The hydroformylation preferably takes place in the presence of water. The mixing ratio of hydrogen to carbon monoxide in the synthesis gas used is preferably in the range from 70:30 to 50:50 percent by volume and in particular from 65:35 to 55:45 percent by volume.

The cobalt-catalyzed hydroformylation process may be carried out as a multistage process which comprises the following 4 stages: preparation of the catalyst (precarbonylation), catalyst extraction, olefin hydroformylation, and catalyst removal from the reaction product (decobaltization). In the first stage of the process, the precarbonylization, the starting material used is an aqueous cobalt salt solution, e.g. cobalt formate or cobalt acetate, which is reacted with carbon monoxide and hydrogen to prepare the catalyst complex ($HCo(CO)_4$) needed for the hydroformylation. In the second stage of the process, the catalyst extraction, the cobalt catalyst prepared in the first stage of the process is extracted from the aqueous phase using an organic phase, preferably using the olefin to be hydroformylated. Besides the olefin, it is sometimes useful to use the reaction products and byproducts from the hydroformylation for catalyst extraction, as long as these are insoluble in water and liquid under the selected reaction conditions. After separation of the phases, the organic phase loaded with the cobalt catalyst is fed to the third stage of the process, the hydroformylation. In the fourth stage of the process, the decobaltization, the organic phase of the reactor discharge is freed from the cobalt carbonyl complexes in the presence of complex-free process water by treatment with oxygen or air. During this, the cobalt catalyst is oxidatively broken down and the resultant cobalt salts are extracted back into the aqueous phase. The aqueous cobalt salt solution obtained from the decobaltization is recirculated into the first stage of the process, the precarbonylation. The crude hydroformylation product obtained may be fed directly to the hydrogenation. As an alternative, a C13 aldehyde fraction may be isolated from this in a usual manner, e.g. by distillation, and fed to the hydrogenation. The formation of the cobalt catalyst, the extraction of the cobalt catalyst into the organic phase, and the hydroformylation of the olefins may also be carried out in a single-stage process in the hydroformylation reactor.

Examples of cobalt compounds which may be used are cobalt(II) chloride, cobalt(II) nitrate, the amine or hydrate complexes of these, cobalt carboxylates, such as cobalt formate, cobalt acetate, cobalt ethylhexanoate, or cobalt naphthenoate, and also the cobalt caprolactamate complex. Under the hydroformylation conditions, the catalytically active cobalt compounds form in situ as cobalt carbonyls. It is also possible to use the carbonyl complexes of cobalt, such as dicobalt octacarbonyl, tetracobalt dodecacarbonyl, or hexacobalt hexadecacarbonyl.

The aldehyde mixture obtained during the hydroformylation is reduced to give primary alcohols. Some degree of reduction generally takes place under the hydroformylation conditions, and the hydroformylation here may also be controlled so that substantially complete reduction takes place. However, the hydroformylation product obtained is generally hydrogenated in another step of the process using hydrogen gas or a gas mixture comprising hydrogen. The hydrogenation generally takes place in the presence of a heterogeneous hydrogenation catalyst. The hydrogenation catalyst used may be any desired catalyst suitable for hydrogenating aldehydes to give primary alcohols. Examples of suitable catalysts available commercially are copper chromite, cobalt, cobalt compounds, nickel, nickel compounds, which may, where appropriate, comprise small amounts of chromium or other promoters, and mixtures of copper, nickel, and/or chromium. The nickel compounds are generally in supported form on support materials such as alumina or kieselguhr. It is also possible to use catalysts comprising precious metals, such as platinum or palladium.

The hydrogenation may take place by the trickle-flow method, where the mixture to be hydrogenated and the hydrogen gas or, respectively, the hydrogen-containing gas mixture are passed, for example concurrently, over a fixed bed of the hydrogenation catalyst. The hydrogenation preferably takes place at from 50 to 250 degrees C., in particular from 100 to 150 degrees C., and at a hydrogen pressure of from 50 to 350 bar, in particular from 150 to 300 bar. Fractional distillation can be used to separate the desired isotridecanol fraction from the C 8 hydrocarbons and higher-boiling products present in the reaction discharge obtained during the hydrogenation.

The resultant isotridecanols particularly preferred for the purposes of the present invention have a characteristic distribution of isomers, which can be defined in more detail by means of gas chromatography, for example. The tridecanol mixture comprises certain percentages of linear or branched tridecanols, where the percentages are determined by gas chromatography. Usually, the percentages are relative to the total area over all of the tridecanols comprised in the mixture analyzed. The percentages determined by gas chromatography are typically area percentages, e.g. of the gas chromatogram areas under the corresponding sections of the gas chromatogram curves as detected by a flame ionization detector (FID). The percentages of the components in the tridecanol mixture (e.g. the tridecanols, and if present dodecanol and tetradecanol), may sum up to 100%.

The gas chromatogram can be divided into three retention regions, for example as described by Kovacs (Z. Anal. Chem. 181, (1961), p. 351; Adv. Chromatogr. 1 (1965), p. 229) with the aid of retention indices ("RI") and using n-undecanol, n-dodecanol, and n-tridecanol as reference substances:

Region 1: Retention index less than 1180

Region 2: Retention index from 1180 to 1217

Region 3: Retention index greater than 1217

The substances present in region 1 are mainly at least triply branched tridecanols, those present in region 2 are mainly doubly branched isotridecanols, and those present in region 3 are mainly singly-branched isotridecanols and/or n-tridecanol. For the purposes of the present invention, this method gives an adequately precise determination of the composition of isotridecanols by comparing the areas under the corresponding sections of the gas chromatogram curves (percent by area). Usually, a flame ionization detector is used for detecting the gas chromatogram curves and the resulting area percentages.

The diester of adipic acid with the tridecanol mixture can be saponified to obtain adipic acid and the tridecanol mixture, and then the tridecanol mixture may be analyzed by the gas chromatography.

The tridecanol mixture comprises 20 to 60%, preferably 25 to 50%, and in particular 40 to 48% of at least triply branched tridecanols.

The tridecanol mixture comprises 10 to 50%, preferably 20 to 45%, and in particular 30 to 40% doubly branched tridecanols.

The tridecanol mixture comprises 5 to 30%, preferably 10 to 25%, and in particular 15 to 20% singly branched and/or linear tridecanols.

In another form the tridecanol mixture comprises 25 to 50% of at least triply branched tridecanols, 20 to 45% doubly branched tridecanols, and 10 to 25% singly branched and/or linear tridecanols.

In another form the tridecanol mixture comprises 40 to 48% of at least triply branched tridecanols, 30 to 40% doubly branched tridecanols, and 15 to 20% singly branched and/or linear tridecanols.

The tridecanol mixture comprises usually at least 85 wt %, preferably at least 95 wt %, and in particular at least 98 wt % of linear or branched tridecanols, for example as determined by gas chromatography.

The tridecanol mixture may comprise in addition to the linear or branched tridecanols also minor amounts of dodecanol and tetradecanol.

The tridecanol mixture comprises usually less than 15%, preferably less than 5 wt %, and in particular less than 2 wt % dodecanol, for example as determined by gas chromatography.

The tridecanol mixture comprises usually less than 5%, preferably less than 3 wt %, and in particular less than 1 wt % tetradecanol, for example as determined by gas chromatography.

The density of the tridecanol mixture is generally from 0.8 to 0.9 g/cm$^3$, preferably from 0.82 to 0.86 g/cm$^3$, and particularly preferably from 0.84 to 0.845 g/cm$^3$.

The refractive index $n_D^{20}$ of the tridecanol mixture is generally from 1.4 to 1.5, preferably from 1.44 to 1.46, and particularly preferably from 1.446 to 1.45.

The boiling range of the tridecanol mixture is generally from 230 to 280° C., preferably from 240 to 275° C., and particularly preferably from 250 to 270° C.

The tridecanol mixture has usually a degree of branching in the range from 1.1 to 3.5, preferably from 1.5 to 3.0, and in particular from 1.9 to 2.4, for example as determined by H-NMR (e.g. in $CDCl_3$), typically using the integrals of signals of aliphatic CH, $CH_2$ and $CH_3$ groups.

The diester of adipic acid with a tridecanol mixture is obtainable by esterification of adipic acid and the tridecanol mixture. Usually a mixture comprising adipic acid and the tridecanol mixture are reacted in the presence of a catalyst selected from titanium-containing compounds, zirconium-containing compounds, or tin-containing compounds. The esterification between adipic acid and the tridecanol mixture can be carried out using stoichiometric amounts of alcohol and acid, particularly when entrainers are used. However, preference is given to using a stoichiometric excess of the alcohol of from 0.05 to 1.0 mole per mole of acid in order to achieve a complete conversion of the acid.

The mixture may be heated to a temperature in the range of 80° C. to 250° C. Preferably, the esterification reaction is carried out in two stages. In the first stage, without addition of a catalyst, the monoester of the adipic acid is formed. Satisfactory reaction rates are achieved above 100° C., and preferably above 120° C. It is possible to complete the monoester formation at these temperatures. However, it is more advantageous to increase the temperature continuously up to 160° C. The water formed may be removed from the reaction system as an azeotrope with the alcohol, as long as the reaction temperature is above the boiling point of the azeotrope (i.e. in a range from 90 to 100° C. under atmospheric pressure). In the second stage, the esterification of the acid is completed. The second stage is a carried out in the presence of the above-described catalysts at temperatures which are above those employed in the first stage and go up to 250° C. Water formed during the reaction is removed as an azeotrope, with the alcohol acting as an entrainer.

In one form, for workup of the diester a basic aqueous solution may be added, and the remaining tridecanol mixture may be removed. To work up the crude diester the product from the reactor is first neutralized with alkali metal hydroxide or alkaline earth metal hydroxide. The alkaline reagent is employed as an aqueous solution containing from 5 to 20 weight-%, preferably from 10 to 15 weight-%, of the hydroxide, based on the overall weight of the solution. Subsequently any free alcohol can be separated from the reaction mixture. Steam distillation has been found to be useful for this step and can be carried out in simple form by passing steam into the crude product. The removal of the free alcohol is followed by the drying of the diester. In a particularly simple and effective embodiment of this step, drying is achieved by passing an inert gas through the product. The crude ester is then filtered to free it of solids. The filtration is carried out in conventional filtration equipment at room temperature or at temperatures up to 150° C. The filtration can also be facilitated by customary filter aids such as cellulose or silica gel.

The diester may be clear liquid at room temperature, e.g. at 25° C. Typically, in a clear liquid no turbidity is visible.

The diester may be miscible with a polyalphaolefine having a kinematic viscosity at 100° C. of about 6 cSt. This miscibility may be determined in a weight ratio of 50:50 at room temperature, e.g. 25° C. for 24 h.

The diester has usually a pour point below −50° C., preferably below −61° C., and in particular below −64° C. The pour point may be determined according to ASTM D 97.

The diester may have a kinematic viscosity at 40° C. from 15 to 35 mm$^2$/s (cSt), preferably from 18 to 25 mm$^2$/s, and in particular from 21 to 24 mm$^2$/s.

The diester may have a kinematic viscosity at 100° C. from 2 to 15 mm$^2$/s (cSt), preferably from 3 to 9 mm$^2$/s, and in particular from 4 to 6 mm$^2$/s. The kinematic viscosity may be determined according to ASTM D445.

The diester may have a viscosity index of at least 130, preferably at least 140, and in particular of at least 145. The diester may have a viscosity index from 130 to 170, from 140 to 160, and in particular from 145 to 155. The viscosity index may be determined according to ASTM D2270.

The boiling range of the diester is generally from 305 to 340° C., preferably from 315 to 330° C., and particularly preferably from 319 to 325° C.

The lubricant usually further comprises a base oil selected from mineral oils, polyalphaolefins, polymerized and interpolymerized olefins, alkyl naphthalenes, alkylene oxide polymers, silicone oils, phosphate ester and carboxylic acid ester; and/or a lubricant additive.

In one form the lubricant may comprise at least 10 wt %, preferably at least 30 wt % and in particular at least 60 wt % of the diester.

In another form the lubricant may comprise 10-99 wt %, preferably 30-95 wt % and in particular at least 60-95 wt % of the diester.

In another form the lubricant may comprise 1-90 wt %, preferably 5-50 wt % and in particular 20-50 wt % of the base oil.

In another form the lubricant may comprise at least 0.1 wt %, preferably at least 0.5 wt % and in particular at least 1 wt % of the diester.

In another form the lubricant may comprise 0.1-20 wt %, preferably 0.1-150 wt % and in particular at least 0.1-10 wt % of the diester.

In another form the lubricant may comprise 30-99.9 wt %, preferably 50-99 wt % and in particular 70-95 wt % of the base oil.

The lubricant may comprise up to 20 wt %, preferably up to 15 wt % and in particular up to 10 wt % of the lubricant additive.

In another form the lubricant may comprise 0.1-20 wt %, preferably 0.1-15 wt % and in particular at least 0.1-10 wt % of the lubricant additive.

Lubricants usually refers to composition which are capable of reducing friction between surfaces, such as surfaces of mechanical devices. A mechanical device may be a mechanism consisting of a device that works on mechanical principles. Suitable mechanical device are bearings, gears, joints and guidances. The mechanical device may be operated at temperatures in the range of −30 C to 80° C.

The base oil may selected from the group consisting of mineral oils (Group I, II or III oils), polyalphaolefins (Group IV oils), polymerized and interpolymerized olefins, alkyl naphthalenes, alkylene oxide polymers, silicone oils, phosphate esters and carboxylic acid esters (Group V oils). Preferably, the base oil is selected from Group I, Group II, Group III base oils according to the definition of the API, or mixtures thereof. Definitions for the base oils are the same as those found in the American Petroleum Institute (API) publication "Engine Oil Licensing and Certification System", Industry Services Department, Fourteenth Edition, December 1996, Addendum 1, December 1998. Said publication categorizes base oils as follows:

a) Group I base oils contain less than 90 percent saturates (ASTM D 2007) and/or greater than 0.03 percent sulfur (ASTM D 2622) and have a viscosity index (ASTM D 2270) greater than or equal to 80 and less than 120.

b) Group II base oils contain greater than or equal to 90 percent saturates and less than or equal to 0.03 percent sulfur and have a viscosity index greater than or equal to 80 and less than 120.

c) Group III base oils contain greater than or equal to 90 percent saturates and less than or equal to 0.03 percent sulfur and have a viscosity index greater than or equal to 120.

d) Group IV base oils contain polyalphaolefins. Polyalphaolefins (PAO) include known PAO materials which typically comprise relatively low molecular weight hydrogenated polymers or oligomers of alphaolefins which include but are not limited to C2 to about C32 alphaolefins with the C8 to about C16 alphaolefins, such as 1-octene, 1-decene, 1-dodecene and the like being preferred. The preferred polyalphaolefins are poly-1-octene, poly-1-decene, and poly-1-dodecene.

e) Group V base oils contain any base oils not described by Groups I to IV. Examples of Group V base oils include alkyl naphthalenes, alkylene oxide polymers, silicone oils, and phosphate esters.

Synthetic base oils include hydrocarbon oils and halo-substituted hydrocarbon oils such as polymerized and interpolymerized olefins (e.g., polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic base oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of polyethylene glycol having a molecular weight of 1000 to 1500); and mono- and polycarboxylic esters thereof, for example, the acetic acid esters, mixed C3-C8 fatty acid esters and C13 oxo acid diester of tetraethylene glycol.

Silicon-based oils such as the polyalkyl-, polyaryl-, polyalkoxy- or polyaryloxysilicone oils and silicate oils comprise another useful class of synthetic base oils; such base oils include tetraethyl silicate, tetraisopropyl silicate, tetra-(2-ethylhexyl)silicate, tetra-(4-methyl-2-ethylhexyl) silicate, tetra-(p-tert-butyl-phenyl) silicate, hexa-(4-methyl-2-ethylhexyl)disiloxane, poly(methyl) siloxanes and poly (methylphenyl)siloxanes. Other synthetic base oils include liquid esters of phosphorous-containing acids (e.g., tricresyl phosphate, trioctyl phosphate, diethyl ester of decylphosphonic acid) and polymeric tetrahydrofurans.

Suitable lubricant additives may be selected from viscosity index improvers, polymeric thickeners, antioxidants, corrosion inhibitors, detergents, dispersants, anti-foam agents, dyes, wear protection additives, extreme pressure additives (EP additives), anti-wear additives (AW additives), friction modifiers, metal deactivators, pour point depressants.

The viscosity index improvers include high molecular weight polymers that increase the relative viscosity of an oil at high temperatures more than they do at low temperatures. Viscosity index improvers include polyacrylates, polymethacrylates, alkylmethacrylates, vinylpyrrolidone/methacrylate copolymers, poly vinylpyrrolidones, polybutenes, olefin copolymers such as an ethylene-propylene copolymer or a styrene-butadiene copolymer or polyalkene such as PIB, styrene/acrylate copolymers and polyethers, and combinations thereof. The most common VI improvers are methacrylate polymers and copolymers, acrylate polymers, olefin polymers and copolymers, and styrenebutadiene copolymers. Other examples of the viscosity index improver include polymethacrylate, polyisobutylene, alpha-olefin polymers, alpha-olefin copolymers (e.g., an ethylenepropylene copolymer), polyalkylstyrene, phenol condensates, naphthalene condensates, a styrenebutadiene copolymer and the like. Of these, polymethacrylate having a number average molecular weight of 10000 to 300000, and alpha-olefin polymers or alpha-olefin copolymers having a number average molecular weight of 1000 to 30000, particularly ethylene-alpha-olefin copolymers having a number average molecular weight of 1000 to 10000 are preferred. The viscosity index increasing agents can be added and used individually or in the form of mixtures, conveniently in an amount within the range of from 0.05 to 20.0% by weight, in relation to the weight of the base stock.

Suitable (polymeric) thickeners include, but are not limited to, polyisobutenes (PIB), oligomeric co-polymers (OCPs), polymethacrylates (PMAs), copolymers of styrene and butadiene, or high viscosity esters (complex esters).

Antioxidants include phenolic antioxidants such as hindered phenolic antioxidants or non-phenolic oxidation inhibitors.

Useful phenolic antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with alkyl groups having 6 carbon atoms or more and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic propionic ester derivatives. Bis-phenolic antioxidants may also be used in combination with the present invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$, where $R^8$ is an aliphatic, aromatic or substituted aromatic group, $R^9$ is an aromatic or a substituted aromatic group, and $R^{10}$ is H, alkyl, aryl or $R^{11}S(o)_xR^{12}$, where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine. Sulfurized alkyl phenols and alkali or alkaline earth metal salts thereof also are useful antioxidants.

Corrosion inhibitors may include various oxygen-, nitrogen-, sulfur-, and phosphorus-containing materials, and may include metal-containing compounds (salts, organometallics, etc.) and nonmetal-containing or ashless materials. Corrosion inhibitors may include, but are not limited to, additive types such as, for example, hydrocarbyl-, aryl-, alkyl-, arylalkyl-, and alkylaryl-versions of detergents (neutral, overbased), sulfonates, phenates, salicylates, alcoholates, carboxylates, salixarates, phosphites, phosphates, thiophosphates, amines, amine salts, amine phosphoric acid salts, amine sulfonic acid salts, alkoxylated amines, etheramines, polyetheramines, amides, imides, azoles, diazoles, triazoles, benzotriazoles, benzothiadoles, mercaptobenzothiazoles, tolyltriazoles (TTZ-type), heterocyclic amines, heterocyclic sulfides, thiazoles, thiadiazoles, mercaptothiadiazoles, dimercaptothiadiazoles (DMTD-type), imidazoles, benzimidazoles, dithiobenzimidazoles, imidazolines, oxazolines, Mannich reactions products, glycidyl ethers, anhydrides, carbamates, thiocarbamates, dithiocarbamates, polyglycols, etc., or mixtures thereof.

Detergents include cleaning agents that adhere to dirt particles, preventing them from attaching to critical surfaces. Detergents may also adhere to the metal surface itself to keep it clean and prevent corrosion from occurring. Detergents include calcium alkylsalicylates, calcium alkyl-phenates and calcium alkarylsulfonates with alternate metal ions used such as magnesium, barium, or sodium. Examples of the cleaning and dispersing agents which can be used include metal-based detergents such as the neutral and basic alkaline earth metal sulphonates, alkaline earth metal phenates and alkaline earth metal salicylates alkenylsuccinimide and alkenylsuccinimide esters and their borohydrides, phenates, salienius complex detergents and ashless dispersing agents which have been modified with sulphur compounds. These agents can be added and used individually or in the form of mixtures, conveniently in an amount within the range of from 0.01 to 1.0% by weight in relation to the weight of the base stock; these can also be high total base number (TBN), low TBN, or mixtures of high/low TBN.

Dispersants are lubricant additives that help to prevent sludge, varnish and other deposits from forming on critical surfaces. The dispersant may be a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant or a polyetheramine dispersant. In one embodiment, the succinimide dispersant includes a polyisobutylene-substituted succinimide, wherein the polyisobutylene from which the dispersant is derived may have a number average molecular weight of about 400 to about 5000, or of about 950 to about 1600. In one embodiment, the dispersant includes a borated dispersant. Typically, the borated dispersant includes a succinimide dispersant including a polyisobutylene succinimide, wherein the polyisobutylene from which the dispersant is derived may have a number average molecular weight of about 400 to about 5000. Borated dispersants are described in more detail above within the extreme pressure agent description.

Anti-foam agents may be selected from silicones, polyacrylates, and the like. The amount of anti-foam agent in the lubricant compositions described herein may range from 0.001 wt.-% to 0.1 wt.-% based on the total weight of the formulation. As a further example, an anti-foam agent may be present in an amount from about 0.004 wt.-% to about 0.008 wt.-%.

Suitable extreme pressure agent is a sulfur-containing compound. In one embodiment, the sulfur-containing compound may be a sulfurised olefin, a polysulfide, or mixtures thereof. Examples of the sulfurised olefin include a sulfurised olefin derived from propylene, isobutylene, pentene; an organic sulfide and/or polysulfide including benzyldisulfide; bis-(chlorobenzyl) disulfide; dibutyl tetrasulfide; di-tertiary butyl polysulfide; and sulfurised methyl ester of oleic acid, a sulfurised alkylphenol, a sulfurised dipentene, a sulfurised terpene, a sulfurised Diels-Alder adduct, an alkyl sulphenyl N'N-dialkyl dithiocarbamates; or mixtures thereof. In one embodiment, the sulfurised olefin includes a sulfurised olefin derived from propylene, isobutylene, pentene or mixtures thereof. In one embodiment the extreme pressure additive sulfur-containing compound includes a dimercaptothiadiazole or derivative, or mixtures thereof. Examples of the dimercaptothiadiazole include compounds such as 2,5-dimercapto-1,3,4-thiadiazole or a hydrocarbyl-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form derivatives or oligomers of two or more of said thiadiazole units. Suitable 2,5-dimercapto-1,3,4-thiadiazole derived compounds include for example 2,5-bis(tert-nonyldithio)-1,3,4-thiadiazole or 2-tert-nonyldithio-5-mercapto-1,3,4-thiadiazole. The number of carbon atoms on the hydrocarbyl substituents of the hydrocarbyl-substituted 2,5-dimercapto-1,3,4-thiadiazole typically include 1 to 30, or 2 to 20, or 3 to 16. Extreme pressure additives include compounds containing boron and/or sulfur and/or phosphorus. The extreme pressure agent may be present in the lubricant compositions at 0 wt.-% to about 20 wt.-%, or at about 0.05 wt.-% to about 10.0 wt.-%, or at about 0.1 wt.-% to about 8 wt.-% of the lubricant composition.

Examples of anti-wear additives include organo borates, organo phosphites such as didodecyl phosphite, organic sulfur-containing compounds such as sulfurized sperm oil or sulfurized terpenes, zinc dialkyl dithiophosphates, zinc diaryl dithiophosphates, phosphosulfurized hydrocarbons and any combinations thereof.

Friction modifiers may include metal-containing compounds or materials as well as ashless compounds or materials, or mixtures thereof. Metal-containing friction modifiers include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, and the like.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances, fatty organic acids, fatty amines, and sulfurized fatty acids may be used as suitable friction modifiers. Examples of friction modifiers include fatty acid esters and amides, organo molybdenum compounds, molybdenum dialkylthiocarbamates and molybdenum dialkyl dithiophosphates.

Suitable metal deactivators include benzotriazoles and derivatives thereof, for example 4- or 5-alkylbenzotriazoles (e.g. triazole) and derivatives thereof, 4,5,6,7-tetrahydrobenzotriazole and 5,5'-methylenebisbenzotriazole; Mannich bases of benzotriazole or triazole, e.g. 1-[bis(2-ethylhexyl) aminomethyl) triazole and 1-[bis(2-ethylhexyl) aminomethyl)benzotriazole; and alkoxy-alkylbenzotriazoles such as 1-(nonyloxymethyl)benzotriazole, 1-(1-butoxyethyl) benzotriazole and 1-(1-cyclohexyloxybutyl) triazole, and combinations thereof. Additional non-limiting examples of the one or more metal deactivators include 1,2,4-triazoles and derivatives thereof, for example 3-alkyl(or aryl)-1, 2,4-triazoles, and Mannich bases of 1,2,4-triazoles, such as 1-[bis(2-ethylhexyl) aminomethyl-1, 2,4-triazole; alkoxyalkyl-1, 2,4-triazoles such as 1-(1-butoxyethyl)-1,2,4-triazole; and acylated 3-amino-1, 2,4-triazoles, imidazole derivatives, for example 4,4'-methylenebis(2-undecyl-5-methylimidazole) and bis[(N-methyl)imidazol-2-yl]-carbinol octyl ether, and combinations thereof. Further non-limiting examples of the one or more metal deactivators include sulfur-containing heterocyclic compounds, for example 2-mercaptobenzothiazole, 2,5-dimercapto-1, 3,4-thia-diazole and derivatives thereof; and 3,5-bis[di(2-ethylhexyl) aminomethyl]-1, 3,4-thiadiazolin-2-one, and combinations thereof. Even further non-limiting examples of the one or more metal deactivators include amino compounds, for example salicylidenepropylenediamine, salicylaminoguanidine and salts thereof, and combinations thereof. The one or more metal deactivators are not particularly limited in amount in the composition but are typically present in an amount of from about 0.01 to about 0.1, from about 0.05 to about 0.01, or from about 0.07 to about 0.1, wt.-% based on the weight of the composition. Alternatively, the one or more metal deactivators may be present in amounts of less than about 0.1, of less than about 0.7, or less than about 0.5, wt.-% based on the weight of the composition.

Pour point depressants (PPD) include polymethacrylates, alkylated naphthalene derivatives, and combinations thereof. Commonly used additives such as alkylaromatic polymers and polymethacrylates are also useful for this purpose. Typically, the treat rates range from 0.001 wt.-% to 1.0 wt.-%, in relation to the weight of the base stock.

Demulsifiers include trialkyl phosphates, and various polymers and copolymers of ethylene glycol, ethylene oxide, propylene oxide, or mixtures thereof.

Examples for lubricants and of uses of the diester are axel lubrication, medium and heavy duty engine oils, industrial engine oils, marine engine oils, automotive engine oils, crankshaft oils, compressor oils, refrigerator oils, hydrocarbon compressor oils, very low-temperature lubricating oils and fats, high temperature lubricating oils and fats, wire rope lubricants, textile machine oils, refrigerator oils, aviation and aerospace lubricants, aviation turbine oils, transmission oils, gas turbine oils, spindle oils, spin oils, traction fluids, transmission oils, plastic transmission oils, passenger car transmission oils, truck transmission oils, industrial transmission oils, industrial gear oils, insulating oils, instrument oils, brake fluids, transmission liquids, shock absorber oils, heat distribution medium oils, transformer oils, fats, chain oils, minimum quantity lubricants for metalworking operations, oil to the warm and cold working, oil for water-based metalworking liquids, oil for neat oil metalworking fluids, oil for semi-synthetic metalworking fluids, oil for synthetic metalworking fluids, drilling detergents for the soil exploration, hydraulic oils, in biodegradable lubricants or lubricating greases or waxes, chain saw oils, release agents, molding fluids, gun, pistol and rifle lubricants or watch lubricants and food grade approved lubricants.

The invention further relates to a method for reducing friction between moving surfaces comprising the step of contacting the surfaces with the lubricant or with the diester.

The friction may be determined by measuring the friction coefficient at 25% slide roll ratio (SRR) using mini-traction machine (MTM) measurements at 70° C. and 1 GPa.

The diester according to the invention may be used for many purposes in lubricants, e.g. for increasing the viscosity index of the lubricant, for thickening of the lubricant, for improving the coefficient of friction of the lubricant, for reducing wear, or as a base stock for the lubricant.

EXAMPLES

Example 1: Tridecanol Mixture

A technical mixture of tridecanol was prepared as described in US 2003/0187114 starting from a technical Ca-raffinate. A technical mixture of butane and butenes isomers was subjected to dimerization on a heterogeneous catalyst to produce a mixture of octene isomers and dodecene isomers. The dodecene isomers were separated by distillation. The isomeric dodecenes were hydroformylated with synthesis gas comprising hydrogen and carbon monooxide, and subsequently hydrogenated with hydrogen. The resulting tridecanol mixture was isolated by fractional distillation.

The density of the isotridecanol mix was 0.843 g/cm$^3$, the refractive index $n_D^{20}$ was 1.448, the viscosity was 34.8 mPas, and the boiling range was from 251 to 267° C. (according to DIN 51751).

The fraction of the tridecanol isomers was at least 99.0% by area as determined by gas chromatography according to DIN 55685. The content of dodecanol and of tetradecanol was each below 1% by area as determined by gas chromatography.

Example 2: GC Analysis

The tridecanol mixture from Example 1 was analyzed by gas chromatography as described in US 2003/0187114 using the Kovacs method:

A specimen of the isotridecanol was trimethylsilylated using 1 ml of N-methyl-N-trimethylsilyl-trifluoroacetamide per 100 μl of specimen for 60 minutes at 80° C. For separation by gas chromatography use was made of a Hewlett Packard Ultra 1 separating column of 50 m in length, based on 100%-methylated silicone rubber, with an internal diameter of 0.32 mm. Injector temperature and detector temperature were 250° C. and the oven temperature was 160° C. (isothermal). The split was 80 ml/min. The carrier gas was nitrogen. The inlet pressure was set to 2 bar. 1 μl of the specimen was injected into the gas chromatograph, and the separated constituents were detected by means of FID (flame ionization detector).

The reference substances used here were n-undecanol: Retention index ("RI") 1100 n-dodecanol: Retention index 1200 n-tridecanol Retention index 1300.

For evaluation purposes the gas chromatogram was subdivided into the following regions:

Region 1: Retention index less than 1180

Region 2: Retention index from 1180 to 1217

Region 3: Retention index greater than 1217

The areas of the tridecanol peaks were set to 100 percent by area. The results are summarized in Table 1.

For comparison, a commercial mixture of tridecanols (Exxal® 13 from Exxon Mobil, USA) was analyzed and the results are summarized in Table 1 "Comparative". The density was 0.843-0847 g/cm3, hyroxyl number 275-295 mg KOH/g, boiling range 250-270° C., the fraction of C9 and C10 alcohol was about 2 wt %, and of C14 and higher alcohols about 5 wt %. The amount of C12 alcohols is about 30% according to Table 1 in WO 2010/057847.

TABLE 1

| Retention index | Branching | Ex. 1 | Comparative |
|---|---|---|---|
| less than 1180 | at least triply branched | 46% | 85% |
| 1180 to 1217 | doubly branched | 35% | 13% |
| greater than 1217 | singly branched and/or linear | 19% | 2% |

Example 3: Synthesis of Diester of Adipic Acid

The tridecanol mixture of Example 1 (2.4 mol) and adipic acid (1.0 mol) is reacted in the present of iso-propyl-butyl-titanate (0.001 mol) in an autoclave under inert gas ($N_2$) at a reaction temperature of 230° C. Water which is formed during the reaction is removed from the reaction mixture through an inert gas stream ($N_2$-stream). After about 180 minutes the excess alcohol is removed from the mixture by distillation at a pressure of 50 mbar. The thus obtained diester of adipic acid is then neutralised with 0.5% NaOH at 80° C. Afterwards the organic phase and the aqueous phase are separated, followed by washing the organic phase two times with water. In a further step the organic phase is purified by treating the crude adipic acid ester with steam at 180° C. and 50 mbar. Then the diester of adipic acid is dried by subjecting it to a $N_2$ stream at 150° C. and 50 mbar. Finally the diester of adipic acid is mixed with activated carbon and is filtered using as a rheological agent supratheorit at 80° C. under reduced pressure.

The colourless to yellowish liquid had a boiling range of 321-324° C. (ASTM D1120) and a density of 0.907 at 20° C.

Example 4: Performance Test of Diester

Various performance test of the diester of Example 3 were made and summarized in Table 2. For comparison, a diester of adipic acid and Exxal® 13 (as analyzed in Example 2) is prepared as described in Example 3 ("Comparative Diester") and tested.

The thermal oxidative stability "RPVOT" was tested according to ASTM D2272. This standard test utilizes an oxygen-pressured vessel to evaluate the oxidation stability oils in the presence of water and a copper catalyst coil at 150° C. The time (minutes) was measured until the pressure decreases for 175 kPa below the maximum. The longer it takes, the more resistant the oil is against oxidation. All samples contained 0.5 wt % of the antioxidant Irganox® L06, an octylated phenyl-alpha-naphthylamine commercially available from BASF SE.

The data demonstrated that the viscosity index, the pour point, the flash point, and the thermal oxidative stability improved.

TABLE 2

| | Ex. 3 | Comparative Diester |
|---|---|---|
| Viscosity at 40° C. (ASTM D445) | 23 $mm^2/s$ | 26 $mm^2/s$ |
| Viscosity at 100° C. (ASTM D445) | 5.1 $mm^2/s$ | 5.2 $mm^2/s$ |
| Viscosity Index (ASTM D2270) | 150 | 135 |
| Pour Point (ASTM D97) | −66° C. | −60° C. |
| Flash Point COC (ASTM D92) | 247° C. | 236° C. |
| RPVOT | 1216 min | 758 min |

Example 5: Traction Test

The diester of Example and the Comparative Diester were tested in the MTM (Mini-Traction Machine) instrument using the so-called traction test mode. In this mode, the friction coefficient is measured at a constant mean speed of over a range of slide roll ratios (SRR) to give the traction curve. The disc is held in a bath containing a test lubricant so that the contact between the ball and flat is fully immersed. The ball shaft is aligned with respect to the disk so as to prevent spin in the contact and the slide-roll ratio is con-trolled independently by driving both the ball and the disk with separate motors. The disc and ball used for the experiments were made of steel (AISI 52100), with a hardness of 750 HV and Ra<0.02 μm. The diameter was 45.0 mm and 19.0 mm for the disc and the ball respectively. The tractions curves were run 38 Newton, 200 mm/s speed and 70° C. temperature.

The slide-roll ratio ("SRR") was varied from 0 to 50 percent and the traction coefficient ("T.C.") measured. The resulting diagram is shown in FIG. 1. The square line represents the data for the inventive diester of Example 2, and the triangular line the data for the Comparative Diester. This demonstrated the improved friction properties of the inventive diester.

The invention claimed is:

1. A method for reducing friction between moving surfaces comprising the steps of:

a) obtaining a tridecanol mixture by hydroformylation and hydrogenation of a mixture of isomeric dodecenes obtained by reacting a hydrocarbon mixture comprising butenes on a heterogeneous catalyst, wherein the heterogeneous catalyst comprises nickel oxide, and wherein the heterogeneous catalyst is a precipitation catalyst obtained by mixing aqueous solutions of nickel salts and silicates;

wherein the tridecanol mixture comprises 20 to 60% of at least triply branched tridecanols, 10 to 50% doubly branched tridecanols, and 5 to 30% singly branched and/or linear tridecanols, and where the percentages are determined by gas chromatography;

where the tridecanol mixture comprises less than 5 wt % tetradecanol;

b) obtaining a diester of adipic acid with the tridecanol mixture by esterification of adipic acid and the tridecanol mixture, wherein the diester has a pour point below −50° C. and a viscosity index of at least 140; and c) contacting the surfaces with a lubricant comprising the diester of the adipic acid with the tridecanol mixture.

2. The method according to claim 1 where the tridecanol mixture comprises 25 to 50% of at least triply branched tridecanols.

3. The method according to claim 1 where the tridecanol mixture comprises 20 to 45% doubly branched tridecanols.

4. The method according to claim 1 where the tridecanol mixture comprises 10 to 25% singly branched and/or linear tridecanols.

5. The method according to claim 1 where the tridecanol mixture comprises at least 85 wt % of linear or branched tridecanols.

6. The method according to claim 5 where the tridecanol mixture comprises at least 98 wt % of linear or branched tridecanols.

7. The method according to claim 1 where the tridecanol mixture comprises less than 15 wt % dodecanol.

8. The method according to claim 7 where the tridecanol mixture comprises less than 2 wt % dodecanol.

9. The method according to claim 1 where the tridecanol mixture comprises less than 1 wt % tetradecanol.

10. The method according to claim 5, wherein the tridecanol mixture comprises at least 98 wt % of linear or branched tridecanols, the tridecanol mixture comprises less than 2 wt % dodecanol and the tridecanol mixture comprises less than 1 wt % tetradecanol.

11. The method according to claim 1 further comprising a base oil selected from the group consisting of mineral oils, polyalphaolefins, polymerized and interpolymerized olefins, alkyl naphthalenes, alkylene oxide polymers, silicone oils, phophate ester and carboxylic acid ester; and further comprises a lubricant additive.

12. The method according to claim 1, where the tridecanol mixture comprises less than 3 wt % tetradecanol.

13. The method according to claim 1, wherein the heterogeneous catalyst is a catalyst whose active substantial constituents are from 10 to 70 percent by weight of nickel oxide, from 5 to 30 percent by weight of titanium dioxide and/or zirconium dioxide, and from 0 to 20 percent by weight of aluminum oxide, and the remainder being silicon dioxide.

14. The method according to claim 1, wherein the heterogeneous catalyst is obtainable by precipitating the catalyst composition at a pH of from 5 to 9 by adding an aqueous solution comprising nickel nitrate to an alkali metal water glass solution which comprises titanium dioxide and/or zirconium dioxide, filtering, drying and amlealing at from 350 to 650 degrees C.

15. The method according to claim 1, wherein the diester has a pour point below −61° C.

16. The method according to claim 1, wherein the diester has a viscosity index of at least 145.

17. The method according to claim 1, wherein the nickel salt is nickel nitrate and the silicate is sodium silicate.

* * * * *